US006142647A

United States Patent [19]

Hayakawa

[11] Patent Number: 6,142,647

[45] Date of Patent: Nov. 7, 2000

[54] DARKROOM ILLUMINATION EQUIPMENT

[75] Inventor: Hiroshi Hayakawa, Fujinomiya, Japan

[73] Assignee: Fuji Photo Film Co., Ltd., Kanagawa, Japan

[21] Appl. No.: 08/892,905

[22] Filed: Jul. 15, 1997

[30] Foreign Application Priority Data

Jul. 19, 1996 [JP] Japan ..... 8-190424

[51] Int. Cl.[7] ..... F21V 9/00

[52] U.S. Cl. ..... 362/230; 362/249; 362/293; 362/800

[58] Field of Search ..... 362/800, 249, 362/293, 2, 232, 230

[56] References Cited

U.S. PATENT DOCUMENTS

| | | | |
|---|---|---|---|
| 3,971,929 | 7/1976 | Erdell . | |
| 4,580,196 | 4/1986 | Task | 362/800 |
| 5,028,516 | 7/1991 | Mukunoki et al. | 430/403 |
| 5,161,879 | 11/1992 | McDermott | 362/800 |
| 5,244,776 | 9/1993 | Kawai | 430/363 |
| 5,329,435 | 7/1994 | McQuire | 362/293 |
| 5,461,551 | 10/1995 | Clayton . | |

FOREIGN PATENT DOCUMENTS

| | | |
|---|---|---|
| 26 51 619 | 5/1978 | Germany . |
| 30 14 016 | 10/1980 | Germany . |
| 59-138855 | 9/1984 | Japan . |

*Primary Examiner*—Thomas M. Sember
*Attorney, Agent, or Firm*—Young & Thompson

[57] ABSTRACT

A casing of darkroom illumination equipment is composed of a base assembly and a lid. A substrate mounting light emitting diodes, a milky colored plate, a filter and a transparent plate are placed in the casing. The light emitting diode which emits the light for which spectrum has its peak at the wavelength of 585 nm is used so as not to affect photographic color paper. The filter eliminates the light having wavelengths in the lower slope apart from the peak in the spectrum and allows only the light having the wavelengths at the peak and in the proximity of the peak to pass through.

5 Claims, 3 Drawing Sheets

DARKROOM ILLUMINATION EQUIPMENT

BACKGROUND OF THE INVENTION

1. Field of the Invention

The present invention relates generally to darkroom illumination equipment, and more particularly to darkroom illumination equipment which is installed in a darkroom where sensitized materials such as photographic color paper are handled.

2. Description of Related Art

A tungsten lamp or a sodium-vapor lamp is used for conventional darkroom illumination equipment, and the globe of the lamp is coated with a filter which absorbs light having specific wavelengths in order to eliminate the light having the wavelengths which is harmful to the sensitized material.

In the case of conventional darkroom illumination equipment using the lamp, however, the filter fades in a short time because a lot of light energy must be used, and the life of the filter is not uniform. It is difficult to maintain conventional darkroom illumination equipment as a result.

To solve the above-mentioned problem, Japanese Utility Model Provisional Publication No. 59-138855 has disclosed darkroom illumination equipment that uses a light emitting diode (LED) which generates only a small amount of light energy and emits light whose spectrum has its peak in a low-sensitivity wavelength region of the sensitized material so as to eliminate the need for the filter. However, the peak in the spectrum is broad, and the light which has wavelengths in the lower slope apart from the peak affects the sensitized material.

SUMMARY OF THE INVENTION

The present invention has been developed in view of the above-described circumstances, and has as its object the provision of darkroom illumination equipment which illuminates a darkroom without affecting sensitized material.

To achieve the above-mentioned object, darkroom illumination equipment according to the present invention comprises: a light emitting diode for emitting light whose spectrum has its peak in a low-sensitivity wavelength region of a sensitized material; a filter for eliminating light having wavelengths in a lower slope apart from the peak, and allowing only light having wavelengths at the peak and in a proximity of the peak to pass through; and in the present invention, the darkroom illumination equipment radiates the light emitted by the light emitting diode via the filter.

According to the present invention, the LED is used as a light source so that the light energy which is used can be less than that of a lamp. Thereby, the life of the filter is extended. The LED emits the light whose spectrum has its peak in the low-sensitivity wavelength region of the sensitized material. The filter eliminates the light having wavelengths in the lower slope apart from the peak, and allows only the light having wavelengths at the peak in the spectrum and in a proximity of the peak to pass through. Thus, the darkroom can be illuminated without affecting the sensitized material.

According to the invention, the darkroom illumination equipment is placed on a ceiling or a wall of the darkroom. In this darkroom illumination equipment, a substrate on which a plurality of the LED's are arranged is attached in the base assembly which composes a casing of the darkroom illumination equipment. The filter is supported between the base assembly and the lid member. The filter eliminates the harmful light from the light emitted by the LED's, and the light penetrating through the filter illuminates the darkroom through an opening of the lid member.

According to the invention, the darkroom illumination equipment further comprises a diffuser. Since the LED has a sharp emittingdirectivity, and when the LED is employed as illumination, the darkroom is sectionally illuminated but the whole darkroom is barely illuminated. The diffuser is accordingly used to diffuse the light emitted by the LED, so that the darkroom can be illuminated over a wide area.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

This invention will be described in further detail by way of example with reference to the accompanying drawings.

Figure 1:
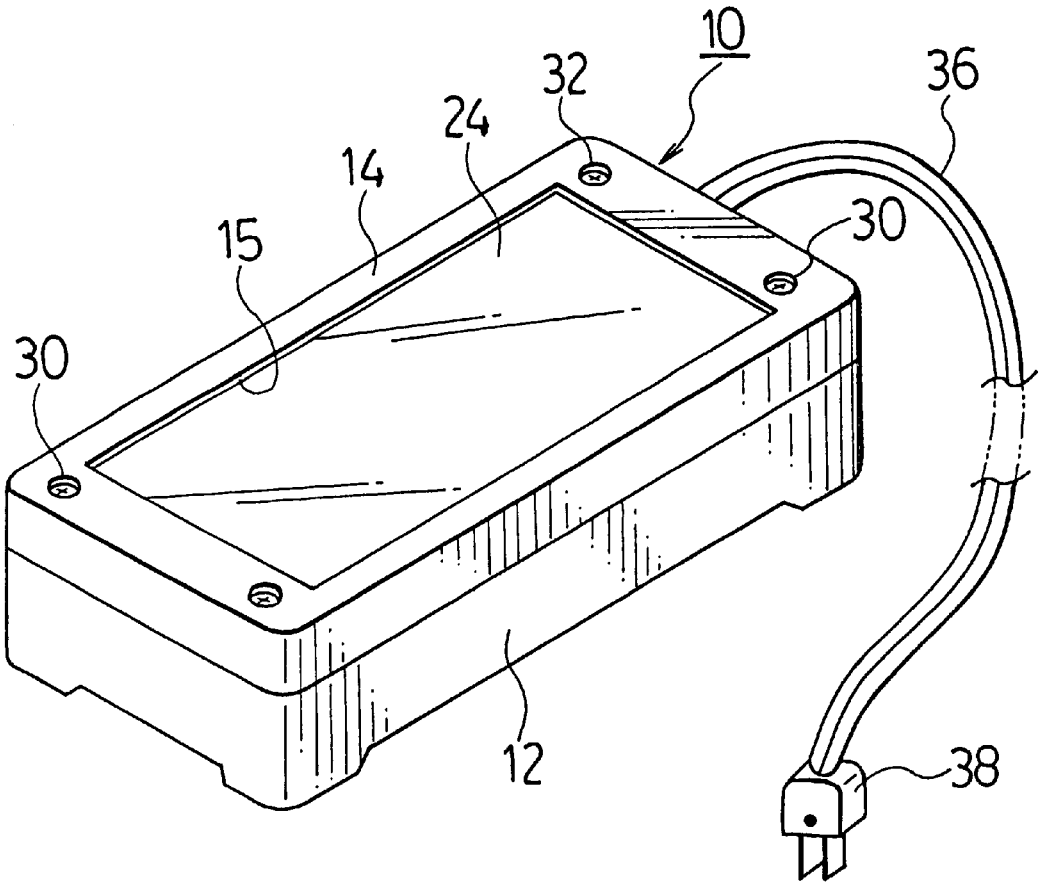
FIG. 1 is a perspective view illustrating darkroom illumination equipment according to an embodiment of the present invention.
Figure 2:
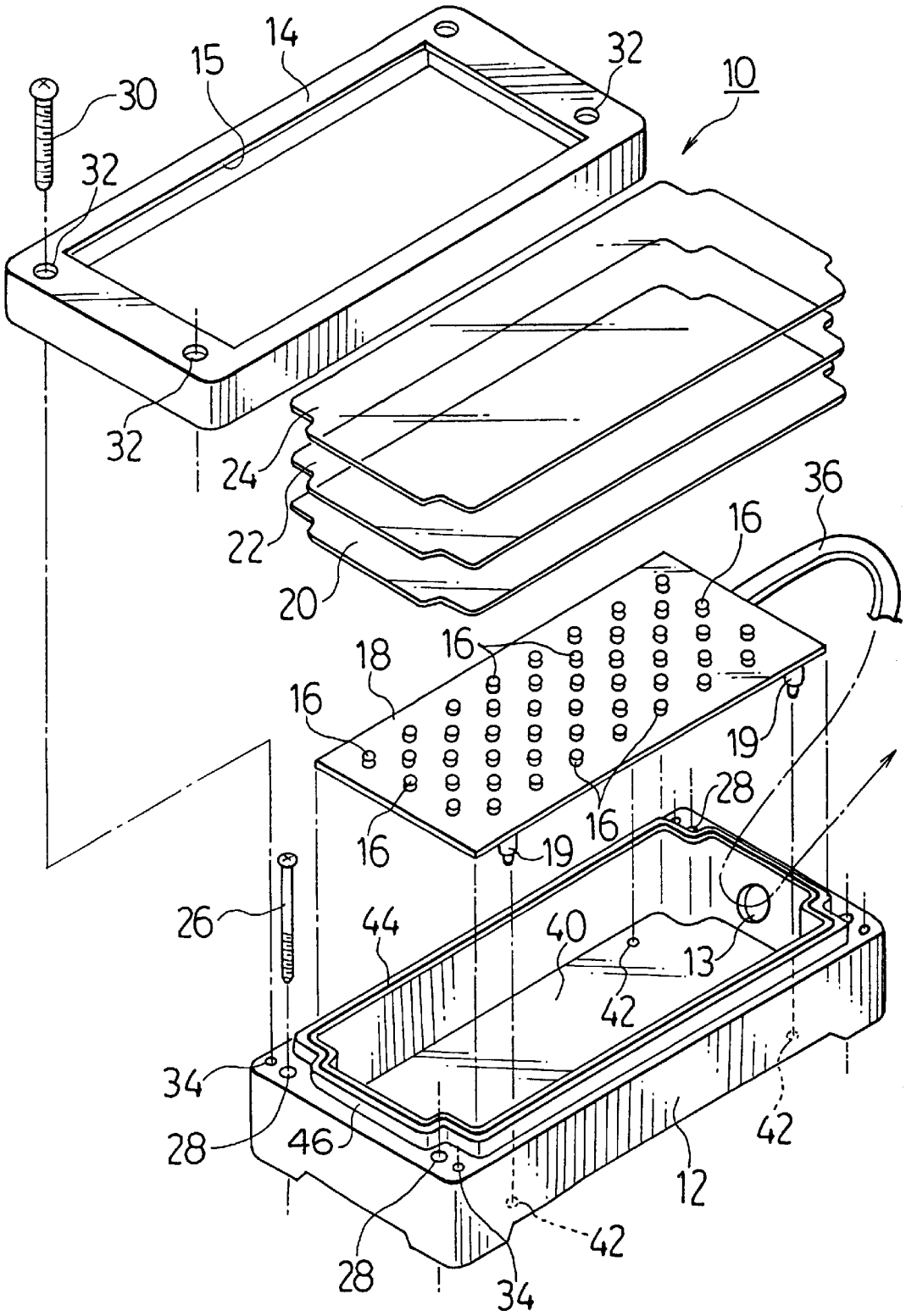
FIG. 2 is an exploded perspective view of the darkroom illumination equipment in FIG. 1.

FIG. 1 is a perspective view of darkroom illumination equipment 10 according to an embodiment for the present invention, and FIG. 2 is an exploded perspective view thereof. The darkroom illumination equipment 10 in FIGS. 1 and 2 is a box and is placed in a darkroom for processing sensitized materials. The darkroom illumination equipment 10 is constructed in such a manner that a casing is composed of a base assembly 12 and a lid 14, and a substrate 18 mounting a number of LED's 16, a milky colored plate 20, which is a diffuser, a filter 22 and a transparent plate 24 are attached in the casing.

The base assembly 12 is rectangular as depicted in FIG. 2. Holes 28 are formed at corners of the base assembly 12, and screws 26 are inserted into the holes 28. The screws 26 fix the darkroom illumination equipment 10 on a ceiling or a wall of the darkroom. Before the lid 14 is fixed on the base assembly 12, the base assembly 12 is fixed with the screws 26 on the ceiling or the wall of the darkroom, so that the darkroom illumination equipment 10 can be fixed.

The lid 14 is rectangular, and a rectangular opening 15 is formed on the lid 14. Holes 32 are formed at corners of the lid 14, and screws 30 are inserted into the holes 32. The screws 30 are screwed into the holes 32 to be engaged with holes 34 on the base assembly 12, and fix the lid 14 on the base assembly 12. Thus, the lid 14 and the base assembly 12 are integrated as shown in FIG. 1.

With reference to FIG. 2, the LED's 16 are arranged on the substrate 18 at regular intervals. A cord 36 is connected with the substrate 18 and supplies electricity to the LED's 16. When the substrate 18 is installed in the base assembly 12, the cord 36 is passed through a side opening 13 of the base assembly 12 to the outside of the base assembly 12. A plug 38 (see FIG. 1) of the cord 36 connects to an electrical outlet in the darkroom. The substrate 18 is inserted into a rectangular concave 40 formed on the base assembly 12, and pins 19 projecting from corners at the bottom of the substrate 18 are engaged with holes 42 formed on the concave 40, so that the substrate 18 can be fixed on the base assembly 12.

Figure 3:
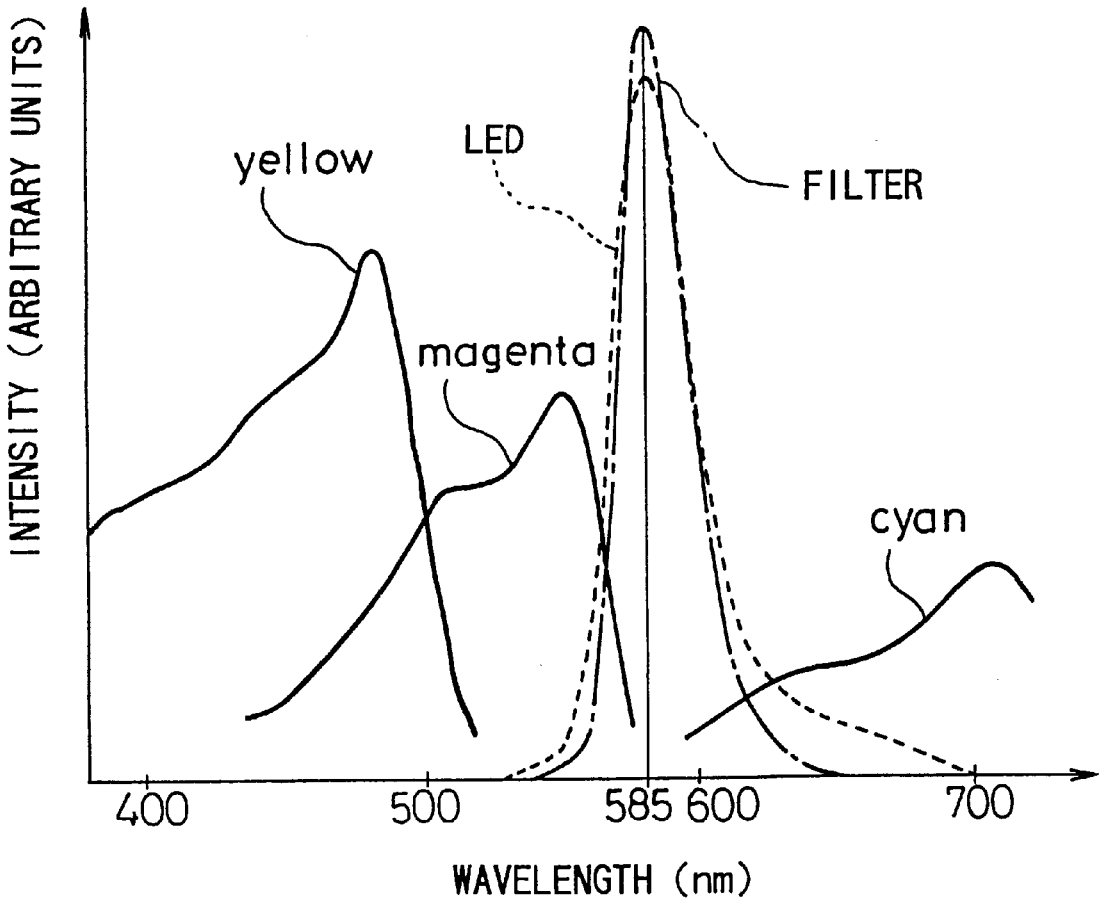
FIG. 3 is a view describing the comparison of spectra for emission characteristics of an LED, transmittance characteristics of a filter, and sensitivity characteristics of sensitizing dyes for photographic color paper.

The LED 16 emits light for which spectrum has its peak at the wavelength of 585 nm as shown with a broken line in FIG. 3, and is, for example, the model GL5HY47 produced by SHARP Co., Ltd. That is, the LED 16 in use in this embodiment emits the light for which the spectrum has the peak in a low-sensitivity wavelength region of photographic color paper.

FIG. 3 is a view describing the comparison of the spectrum for the light emitted by the LED 16, spectral transmittance characteristics of the filter 22, and spectral sensitivity characteristics of sensitized dyes for the photographic color paper. As shown in FIG. 3, the photographic color paper has blue sensitized emulsion (yellow dye) which is sensitized to the blue light having wavelengths of less than 520 nm; green sensitized emulsion (magenta dye) which is sensitized to the green light having wavelengths of between 430 nm and 580 nm; and red sensitized emulsion (cyan dye) which is sensitized to the red light having wavelengths of between 600 nm and 750 nm. Then, the photographic color paper has an insensitive or low-sensitive wavelength region of between 580 nm and 600 nm. The peak in the spectrum for the light emitted by the LED 16 is in the insensitive wavelength region.

Consequently, the light emitted by the LED 16 having wavelengths at the peak in the spectrum and in the proximity of the peak does not affect the photographic color paper. The lower slope apart from the peak in the spectrum for the light emitted by the LED 16, however, overlaps with the sensitive wavelength-regions of the green sensitized emulsion and the red sensitized emulsion, and hence the light of which wavelengths are in the lower slope affects the photographic color paper.

In order to eliminate the above-stated disadvantages, in this embodiment, there is provided the filter 22 in front of the LED's 16 as shown in FIG. 2. The filter 22 eliminates the light having the wavelengths in the lower slope apart from the peak in the spectrum for the light emitted by the LED 16, and allows only the light of which wavelengths are at the peak in the spectrum and in the proximity of the peak to pass through. The dotted line in FIG. 3 indicates the spectrum for the light emitted by the LED 16, and the alternate long and short dash line indicates the spectral transmittance characteristics of the filter 22. The spectral transmittance characteristics of the filter 22 has its peak at the wavelength of 587 nm, and cutoff wavelengths thereof are 564 nm and 635 nm. As shown in FIG. 3, the light emitted by the LED 16 of which wavelengths are in the lower slope apart from the peak in the spectrum is eliminated by the filter 22.

Thus, the darkroom illumination equipment 10 uses the LED's 16 as the light source so that light energy can be much less than that of the lamp. Thereby, the life of the filter 22 can be extended and uniform, and the darkroom illumination equipment 10 can be easily maintained.

In this embodiment, the LED 16 emits the light for which the spectrum has the peak in the low-sensitivity wavelength region of the photographic color paper, and the filter 22 eliminates the light of which the wavelengths are in the lower slope apart from the peak in the spectrum and allows only the light of which the wavelengths at the peak in the spectrum and in the proximity of the peak to pass through. Thus, the darkroom can be illuminated without affecting the photographic color paper.

In this embodiment, the LED which emits the light for which spectrum has the peak at the wavelength of 585 nm is applied to the photographic color paper. An LED which emits light for which spectrum has its peak at a wavelength of more than 500 nm may be applied to photographic monochrome paper, because the photographic monochrome paper is sensitized to the light having wavelengths of between 350 nm and 500 nm. Moreover, an LED which emits light for which spectrum has its peak at the outside of the visible spectrum (in the infrared spectrum for example) may be applied to the photographic color paper. The infrared light emitted by the LED cannot be perceived by a person's eyes, in which case a user wears a pair of infrared glasses to see his environment.

In this embodiment, as indicated in FIG. 2, the milky colored plate 20 as the diffuser is provided between the substrate 18 mounting the LED's 16 and the filter 22. Since the LED 16 has a sharp emitting-directivity, and when the LED 16 is employed as illumination, the darkroom is sectionally illuminated but the whole darkroom is barely illuminated. Then, the milky colored plate 20 is used as is the case in this embodiment, the light emitted by the LED 16 can be diffused, so that the darkroom can be illuminated over a wide area.

On the other hand, a packing 44, which is a continuous ring, is attached to the base assembly 12. The packing 44 is engaged with a groove (not shown) on a projecting part 46 formed on the periphery of the concave 40 on the base assembly 12. The peripheral edge of the milky colored plate 20 is placed on the packing 44, and the filter 22 and the transparent plate 24 are placed on the milky colored plate 20. When the lid 14 is fixed on the base assembly 12 with the screws 30, the milky colored plate 20, the filter 22 and the transparent plate 24 are pinched and fixed between the bottom of the lid 14 and the packing 44. The packing 44 can prevent the light emitted by the LED's 16 from being seen through a joint between the base assembly 12 and the lid 14 as a result.

According to the darkroom illumination equipment 10 which is constructed in the above-mentioned manner, when the LED's 16 are turned on, the light emitted by the LED's 16 is diffused by the milky colored plate 20, and the harmful light is eliminated by the filter 22. Then, the darkroom illumination equipment 10 radiates the light through the opening 15 on the lid 14 via the transparent plate 24.

In this embodiment, the darkroom illumination equipment 10 is a box; however, the present invention should not be restricted to this. Any shape can be adopted for the darkroom illumination equipment, if it radiates the light emitted by the LED 16 via the filter 22.

As set forth hereinabove, according to the darkroom illumination equipment of the present invention, the LED is used as the light source so that the life of the filter can be extended and uniform. The LED emits the light for which spectrum has its peak in the low-sensitivity wavelength region of the sensitized material. The filter eliminates the light having the wavelengths in the lower slope apart from the peak in the spectrum, and allows only the light having the wavelengths at the peak in the spectrum and in the proximity of the peak to pass through. Thus, the darkroom can be illuminated without affecting the sensitized material.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A darkroom illuminating device comprising:

at least one light emitting diode, each of which emits light of a spectrum having only one peak, said one peak lying outside the visible spectrum; and a diffusion member able to diffuse the light emitted by the at least one light emitting diode;

wherein the darkroom illuminating device contains no light sources other than the at least one light emitting diode.

2. The darkroom illuminating device of claim 1, wherein the peak of the spectrum is in the infrared range.

3. The darkroom illuminating device of claim 1, further comprising:

a base assembly;

a lid attached to the base assembly, said lid having an opening disposed therein.

4. The darkroom illuminating device of claim 3, wherein the peak of the spectrum is in the infrared range.

5. The darkroom illuminating device of claim 1, wherein said only one peak lies in a wavelength range to which photographic paper is insensitive.

* * * * *